US005311925A

United States Patent [19]

Waltman

[11] Patent Number: 5,311,925

[45] Date of Patent: May 17, 1994

[54] MAGNESIUM HYDROXIDE TO PREVENT CORROSION CAUSED BY WATER SPRAY IN CONTINUOUS CASTING

[75] Inventor: George B. Waltman, Naperville, Ill.

[73] Assignee: Nalco Chemical Company, Naperville, Ill.

[21] Appl. No.: 150,313

[22] Filed: Nov. 12, 1993

[51] Int. Cl.[5] ..... B22D 11/04; B22D 11/24

[52] U.S. Cl. ..... 164/486; 164/477

[58] Field of Search ..... 164/4.1, 5, 455, 451, 164/452, 477, 486, 487, 444

[56] References Cited

U.S. PATENT DOCUMENTS 4,607,679 8/1986 Tsai et al. ..... 164/5 X

FOREIGN PATENT DOCUMENTS

| | | | |
|---|---|---|---|
| 3317126 | 11/1984 | Fed. Rep. of Germany | 164/486 |
| 58-61955 | 4/1983 | Japan | 164/477 |
| 58-138545 | 8/1983 | Japan | 164/5 |
| 61-219455 | 9/1986 | Japan | 164/5 |
| 62-81254 | 4/1987 | Japan | 164/486 |
| 62-107845 | 5/1987 | Japan | 164/486 |

*Primary Examiner*—J. Reed Batten, Jr.

*Attorney, Agent, or Firm*—Robert A. Miller; James J. Drake; Joseph B. Barrett

[57] ABSTRACT

Magnesium hydroxide is added to aqueous sprays used in the cooling of steel produced by continuous casting to reduce the corrosion of ferrous metals in contact with these sprays. The magnesium hydroxide when added to aqueous sprays used in the cooling of steel produced by continuous casting further reduces the potential for calcium fluoride scale formation by reducing the fluoride content of the system water.

7 Claims, No Drawings

MAGNESIUM HYDROXIDE TO PREVENT CORROSION CAUSED BY WATER SPRAY IN CONTINUOUS CASTING

BACKGROUND OF THE INVENTION

1. Field of the Invention

The invention relates to the prevention of corrosion of ferrous metals in contact with spray water used to cool steel produced by continuous casting processes.

2. Description of the Prior Art

Continuous casting is the process of continuously pouring molten metal from a ladle into complex casting equipment which distributes the liquid, shapes it, cools it and cuts it to the desired length. The casting is continuous as long as the ladle has available metal.

In continuous casting, steel leaving a ladle at about 2800° F. is poured into a trough called a tundish. The bottom of the tundish has one or more openings through which the molten steel is distributed to form slabs or billets in the forming area called the mold. The mold is a water-cooled copper jacket providing for high heat exchange rates. At the start of a cast, a dummy bar is moved close to the top of the mold to completely seal the interior. Mold lubricants high in fluoride salts are added to the molten steel in the tundish to prevent oxidation as well as providing molten lubricity. As the cast starts, this bar is slowly lowered through the mold. The molten metal in contact with the cool mold surface begins to solidify and form a skin. As the newly formed steel shape exits the mold area a series of direct contact water sprays continue the cooling/solidification process. The continuously moving billet or slab then moves through roller guides to the straightening section and then to the runout table for cutting to a specified length.

Spray water that contacts the billet or slab becomes contaminated with iron oxide particles. Contaminated water is processed for reuse by putting it through a scale pit to remove dense, settleable contaminants, and then through filters and heat exchange equipment before returning to the sprays. Failure to remove solids in the water could result in spray plugging which would adversely affect product quality and could even shut down the casting process.

Severe corrosion can occur in continuous casters in the zone immediately below the mold (zero zone). Corrosion results from the formation of hydrofluoric acid from the dissolution of mold powders into the spray water. Calcium fluoride deposition can also occur if the concentration of fluoride reaches the saturation point.

When fluoride salts from the mold powders dissolve in the spray water in the zero zone, hydrofluoric acid forms causing the pH to drop to 2.5 to 3.0. This is a considerably lower pH than is seen in the bulk spray water, which typically ranges from 6.5 to 7.5. To render the spray water less corrosive it has been the practice of some mills to raise the pH of the bulk water with concentrated solutions of sodium hydroxide. While sodium hydroxide has allowed the pH to be elevated control is difficult and, in some instances, pH swings have occurred which allow the pH to reach 10–14. At these elevated pHs the water becomes highly scale forming. Significant deposits of calcium salts can occur causing spray nozzle plugging.

If it were possible to raise the alkalinity in these systems and yet at the same time minimize scale formation, and in particular calcium fluoride scales, an advance in the art would be achieved.

SUMMARY OF THE INVENTION

The invention comprises a process for reducing the corrosion of ferrous metal equipment exposed to the aqueous sprays used to cool steel produced by continuous casting. The process comprises adding magnesium hydroxide to the spray water at the inlet to the scale pit. This water is then filtered, cooled, and recirculated back to the spray system. Alkalinity control is attained by maintaining the pH of the recirculated water between 8.5 and 9.5. At the same time scale formation is reduced because of the lower pH.

DESCRIPTION OF THE PREFERRED EMBODIMENTS

The magnesium hydroxide used in the practice of the invention is in the form of a slurry, most preferably a concentrated slurry. Concentrated slurries of magnesium hydroxide usually have at least 7% by weight, milk of magnesia. It was found that a slurry containing 57% magnesium hydroxide gave excellent results. It is desirable that the slurry be concentrated since one of the important discoveries of this invention is that the magnesium hydroxide particles can remove fluoride from the water through adsorption. Reducing the fluoride concentration will reduce calcium fluoride scale formation.

When the pH of the bulk water is adjusted to within the ranges indicated, additional amounts of acid are neutralized. By neutralizing acid, corrosion of the mild steel structure of the caster will be minimized. At the same time, increasing the pH will cause the water to become more scale forming and could contribute to the formation of calcium fluoride and calcium carbonate scales. Scale inhibitors are applied to prevent the formation of inorganic calcium scales in the system water sprays and on heat exchange surfaces.

While a number of scale inhibitors are capable of controlling calcium scales it is a preferred practice of this invention to use a water soluble, phosphonate scale inhibitor. Phosphonates suitable for use are illustratively listed in U.S. Pat. No. 4,303,568 the disclosure of which is incorporated herein by reference. A preferred inhibitor is 1-(hydroxy)-ethylidene diphosphonic acid, (HEDP). Another useful inhibitor is phosphonobutane tricarboxylic acid. These phosphonate inhibitors are effective in controlling scale at low dosages usually ranging between about 0.5 to about 200 parts per million (ppm) per part by weight of water treated. Good results are achieved when the dosage is within the range of 1–50 ppm. These scale inhibitors preferably are applied to the bulk water supply after it has been filtered and cooled.

EXAMPLE

The invention was evaluated on a continuous caster system using a mobile laboratory which contained a small Pilot Cooling Tower and heat exchange equipment of the type described in the paper *Small Scale Short Term Methods of Evaluating Cooling Water Treatments . . . Are They Worthwhile*, presented at the 36th Annual Meeting of the International Water Conference, Pittsburgh, Nov. 4–6, 1975. Heat exchange was simulated using a circulating pump and a mild steel heat transfer surface. Heat exchange rates of approximately 20,000 BTU/FT$^2$ were used. The results of the evaluation are summarized below.

A 57% concentrated slurry of magnesium hydroxide was added to the caster spray water. Total alkalinity of the water increased from about 50 ppm to about 120 ppm. During a known period of time when hydrofluoric acid was being generated due to the use of mold powders in the casting process, the total alkalinity decreased from 120 ppm to −20 ppm. During the same period the bulk water pH decreased from 7.5 to 3.6.

At the same time that bulk water alkalinity was being decreased by hydrofluoric acid generated from the mold powder, magnesium hydroxide was being fed. Based on the molar relationship between hydrofluoric acid and magnesium hydroxide in the neutralization reaction it was calculated that 1,226 pounds of hydrofluoric acid was neutralized.

Also during this period of time the fluoride content of the bulk water was measured before and after the filters to see if adsorption onto magnesium hydroxide particles and subsequent removal, was occurring. Test showed fluoride reduction of 20–30% across the filters. During the test period, no significant deposition of calcium or magnesium salts was noted on heat exchange surfaces or in the test spray nozzles.

Adjusting the bulk water alkalinity with magnesium hydroxide provided a safe, economical alternative to caustic soda. Magnesium hydroxide provides 1.5 times as much alkalinity per pound as 50% caustic. Magnesium hydroxide is safer with a neat pH of 10.2 versus 50% caustic pH of 14. Overfeed of magnesium hydroxide will not result in high pH and the potential for severe calcium carbonate scale formation.

Finally, the use of magnesium hydroxide will minimize the potential for calcium fluoride scale deposition by removing soluble fluoride from the water through the process of adsorption.

Changes can be made in the composition, operation and arrangement of the method of the present invention described herein without departing from the concept and scope of the invention as defined in the following claims:

I claim:

1. An improved process for reducing the corrosion of ferrous metal equipment in a continuous casting operation comprising spraying a cast steel product with water, collecting the water in a scale pit and recycling the water, the improvement comprising adding an effective amount of an aqueous slurry of magnesium hydroxide to the collected water to maintain the pH of the water between 8.5 to 9.5 prior to recycling.

2. The process of claim 1, wherein an aqueous slurry of magnesium hydroxide is added to the inlet to the scale pit.

3. The process of claim 1, further comprising the step of adding a scale inhibiting amount of a phosphonate scale inhibitor to the collected water.

4. The process of claim 3, wherein the phosphonate scale inhibitor is 1-(hydroxy)-ethylidene-diphosphonic acid.

5. The process of claim 3, wherein the step of recycling comprises filtering and cooling the spray water collected in the scale pit, further comprising the step of adding the phosphonate scale inhibitor to the spray water after the spray water is filtered and cooled.

6. A process for reducing the fluoride content of spray water used to cool steel produced by continuous casting comprising: collecting the spray water in a scale pit;

adding an effective amount of an aqueous slurry of magnesium hydroxide to the collected water to adsorb the fluoride; and removing the adsorbed fluoride through by filtration prior to recycling the water.

7. The process of claim 6, wherein the magnesium hydroxide is added to an inlet to the scale pit.

* * * * *